US009351548B2

(12) United States Patent
Lorenz

(10) Patent No.: US 9,351,548 B2
(45) Date of Patent: May 31, 2016

(54) PRIVACY UMBRELLA

(71) Applicant: Monica D. Lorenz, Grasonville, MD (US)

(72) Inventor: Monica D. Lorenz, Grasonville, MD (US)

( * ) Notice: Subject to any disclaimer, the term of this patent is extended or adjusted under 35 U.S.C. 154(b) by 0 days.

(21) Appl. No.: 14/495,488

(22) Filed: Sep. 24, 2014

(65) Prior Publication Data

US 2015/0083173 A1 Mar. 26, 2015

Related U.S. Application Data

(60) Provisional application No. 61/881,587, filed on Sep. 24, 2013.

(51) Int. Cl.

| | |
|---|---|
| ***A45B 25/20*** | (2006.01) |
| ***A45B 25/18*** | (2006.01) |
| ***A45B 11/04*** | (2006.01) |

(52) U.S. Cl.

CPC ..... *A45B 25/20* (2013.01); *A45B 11/04* (2013.01); *A45B 25/18* (2013.01)

(58) Field of Classification Search

CPC .. A45B 25/18; A45B 25/20; A45B 2025/186; A45B 2025/183

See application file for complete search history.

(56) References Cited

U.S. PATENT DOCUMENTS

| | | | | | |
|---|---|---|---|---|---|
| 50,492 | A | * | 10/1865 | Pond et al. | 135/33.71 |
| 416,352 | A | * | 12/1889 | Andrews | 135/33.71 |
| 919,695 | A | * | 4/1909 | Clapp | 135/33.71 |
| 928,774 | A | * | 7/1909 | Livergood | 135/33.71 |
| 1,039,636 | A | * | 9/1912 | Berntson | 135/33.71 |
| 1,210,126 | A | * | 12/1916 | Wilson | 135/33.71 |
| 1,581,843 | A | * | 4/1926 | Little, Sr. | 135/33.71 |
| 2,024,105 | A | * | 12/1935 | Landman | 135/33.7 |
| 2,841,160 | A | * | 7/1958 | Dewispelere | 135/33.71 |
| 2,875,772 | A | * | 3/1959 | Canady | 135/33.71 |
| 3,892,251 | A | * | 7/1975 | Warfield | 135/15.1 |
| 4,131,954 | A | * | 1/1979 | Brock et al. | 2/171.03 |
| 4,364,193 | A | * | 12/1982 | Visco | 43/1 |
| 4,675,916 | A | * | 6/1987 | Orsini | 2/181 |
| 6,131,591 | A | * | 10/2000 | Hollah | 135/33.2 |
| 6,196,241 | B1 | * | 3/2001 | Doolan | 135/16 |
| 6,223,758 | B1 | * | 5/2001 | Feldman | 135/33.2 |
| 2005/0126615 | A1 | * | 6/2005 | Bell | 135/33.2 |
| 2009/0266391 | A1 | * | 10/2009 | Bloom et al. | 135/34.2 |
| 2011/0240072 | A1 | * | 10/2011 | Barac-Bauer | 135/16 |

FOREIGN PATENT DOCUMENTS

| | | | | |
|---|---|---|---|---|
| FR | 450294 | A | * | 3/1913 |
| FR | 541053 | A | * | 7/1922 |
| GB | 191306770 | A | * | 0/1914 |

* cited by examiner

*Primary Examiner* — David R Dunn
*Assistant Examiner* — Danielle Jackson
(74) *Attorney, Agent, or Firm* — Nixon & Vanderhye P.C.

(57) ABSTRACT

A privacy umbrella includes a canopy, and at least a portion of the canopy includes a section made of a one-way material that allows an individual under the canopy to see outward through the one-way material, but which prevents people outside the canopy from obtaining a good view through the one-way material into the interior of the canopy. The canopy could have only a single panel of one-way material, multiple panels of one-way material, or one or more windows of one-way material. Alternatively, the entire canopy could be formed of a one-way material. The one-way material could be formed from various different materials or layers such that the one-way functionality is obtained.

16 Claims, 6 Drawing Sheets

PRIVACY UMBRELLA

This application claims priority to U.S. Provisional Patent Application No. 61/881,587, which was filed on Sep. 24, 2013, the entire contents of which are incorporated herein by reference.

BACKGROUND OF THE INVENTION

A typical umbrella includes a canopy that is comprised of multiple panels of flexible material mounted on a folding frame. A handle is attached to the folding frame. The panels of flexible material are waterproof or at least water repellant. The panels can be opaque or transparent.

Most umbrellas have a frame and canopy that is generally dome-shaped. However, the canopy can take many different configurations. Some canopies are more curved than others. Thus, some canopies form only a portion of a dome, while other canopies are fully dome-shaped, meaning they form half of a sphere. Still other canopies can be shaped such that they form a full dome (half of a sphere), and the edges of the canopy then extend downward from the dome in a somewhat cylindrical shape. Such a canopy can provide greater amounts of protection for an individual under the canopy.

If the canopy forms only a portion of a dome, it is usually easy for an individual under the umbrella to see outward from under the edges of the canopy. However, if the canopy forms a complete dome, and includes edges that extend downward from the dome, it can be difficult for an individual under the canopy to see outward from under the canopy, because the lower edges of the canopy may be positioned level with or below the individual's eyes. For this reason, such umbrellas may have a canopy formed from a transparent flexible material, so that an individual under the canopy can see through the canopy.

While an umbrella with a transparent canopy allows a user to see outward, it also allows people outside the canopy to see inward to the interior of the umbrella. This could be considered disadvantageous under certain circumstances. For example, a celebrity or other public figure, walking in public, may desire privacy. A canopy that prevents people from seeing inward to the interior of the umbrella could be desirable under such circumstances. However, if the canopy is made from an opaque material that prevents people outside the canopy from seeing inward into the interior of the canopy, the opaque panels would also make it difficult for the individual under the canopy from seeing outward.

DETAILED DESCRIPTION OF PREFERRED EMBODIMENTS

The following detailed description of preferred embodiments refers to the accompanying drawings, which illustrate specific embodiments of the invention. Other embodiments having different structures and features do not depart from the scope of the present invention.

Figure 1:
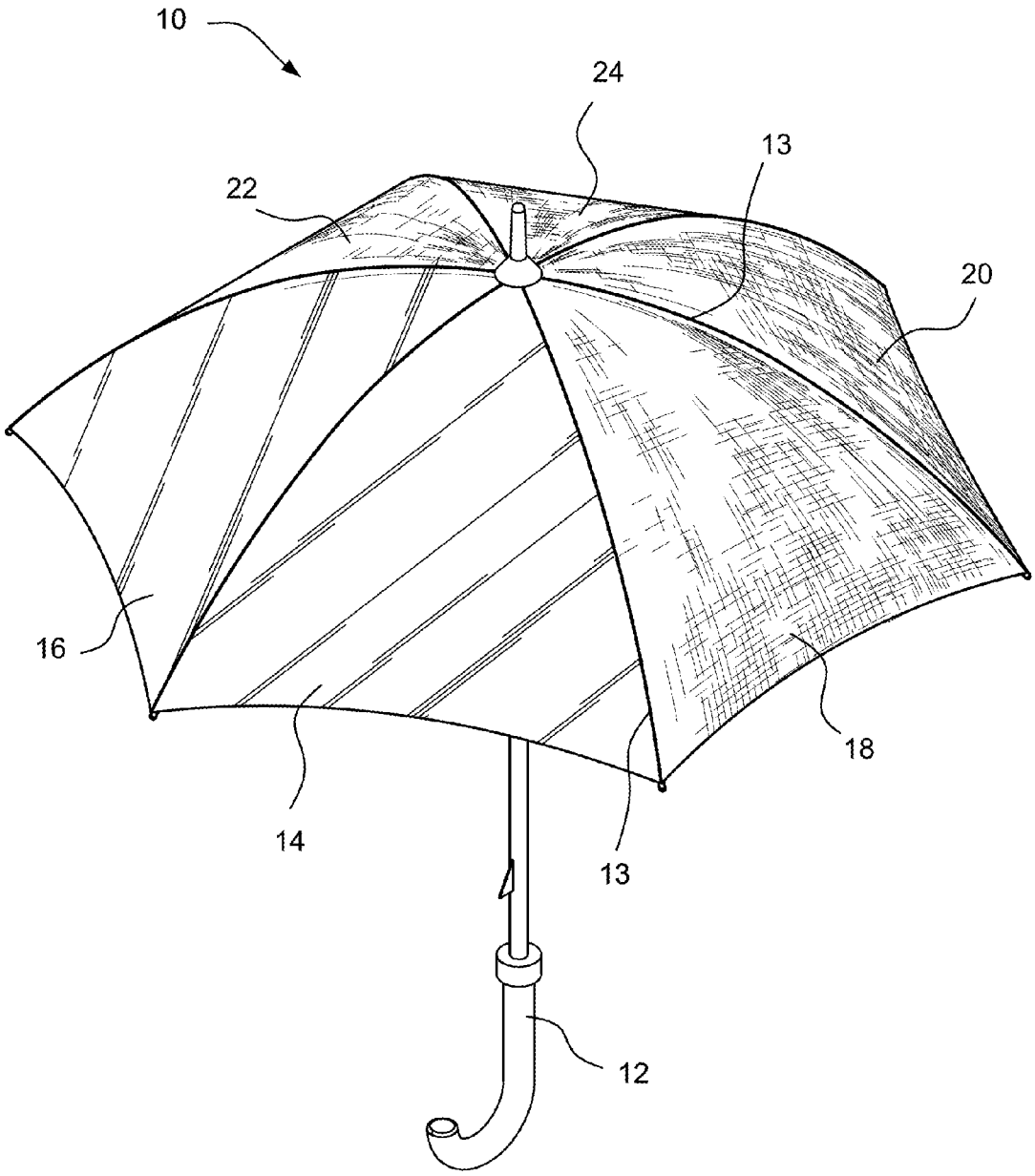
FIG. 1 depicts a first embodiment of a privacy umbrella.

A privacy umbrella 10 as illustrated in FIG. 1 includes a handle 12 connected to frame comprising a plurality of elongated supports 13. The elongated support can move between a folded position and an open position, as is well known to those of ordinary skill in the art. FIG. 1 illustrated the umbrella where the frame is in the open position.

A canopy is attached to the elongated supports 13 that form the frame. In some embodiments, the canopy can be made of multiple of panels of flexible material that extend between the elongated supports 13. In the embodiment illustrated in FIG. 1, two of the panels 14, 16 are made of a "one-way" material, and the remaining panels 18, 20, 22, 24 are made of an opaque material.

In alternate embodiments, the panels 14 and 16 made of the one-way material may actually be a single, unitary sheet of one-way material that is mounted between three of the elongated supports 13. Likewise, the opaque panels 18, 20, 22 and 24 may comprise single sheet of opaque material attached to multiple elongated supports 13. Edges of the single sheet of one-way material would be joined to edges of the single sheet of opaque material.

The panels 14, 16 made of one-way material allow an individual whose head is positioned under the canopy to see outward through the one-way panels 14, 16. However, people located outside the canopy are unable to obtain an effective view inward through the one-way panels 14, 16. The one-way panels provide multiple benefits as compared to opaque or transparent panels.

The one-way panels are advantageous over opaque panels because they allow a user's head to be positioned deeply under the canopy, while still allowing the user to see outward in order to walk or navigate through their surroundings. If it is raining, this would allow a user to stay dry, while still allowing the user to maintain good outward vision. A user seeking protection from the sun could likewise remain covered under the canopy while still seeing outward through the one-way panels.

The one-way panels are advantageous over transparent panels because they prevent people outside the canopy from seeing portions of the user's head and body that are positioned under the canopy, preserving the user's privacy. A celebrity or other public figure, walking in public, could utilize such a privacy umbrella to prevent photographers from obtaining pictures, while still allowing the user to see outward through the one-way panels.

Figure 2:
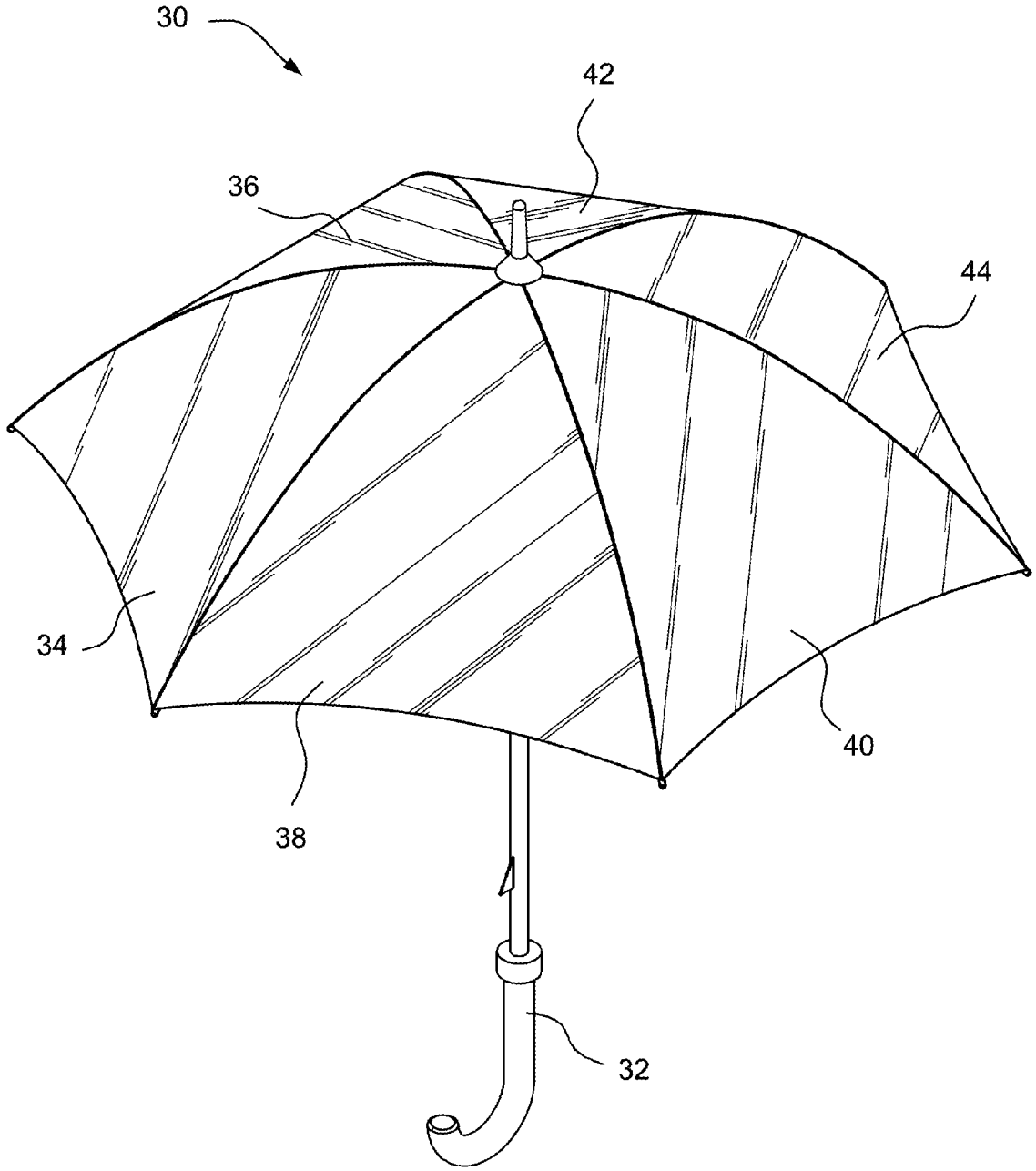
FIG. 2 depicts a second embodiment of a privacy umbrella.

The embodiment of a one-way vision privacy umbrella 30 illustrated in FIG. 2 includes a canopy made from multiple panels of one-way material 34, 36, 38, 40, 42 and 44, all of which provide one-way functionality. Thus, the user could see outward through any portion of the canopy, and people located outside the canopy are unable to effectively see inward through any of the panels. An umbrella as illustrated in FIG. 2 could be formed from multiple individual panels of one way material, or the entire canopy could be formed from a single piece of one-way material.

Figure 3:
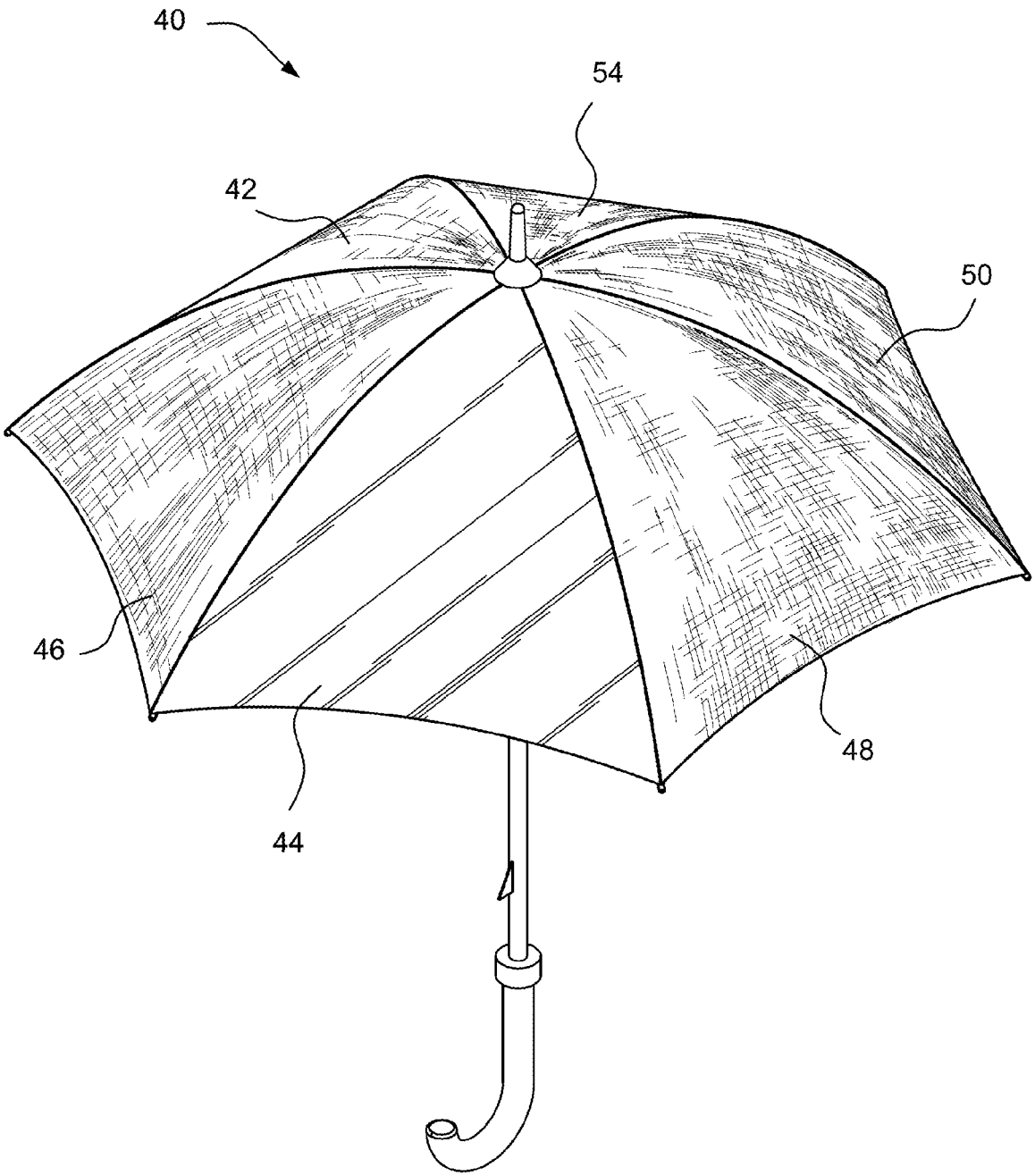
FIG. 3 depicts a third embodiment of a privacy umbrella.

In alternate embodiments, different panels or portions of the canopy could be made of a one-way material. For example, FIG. 3 illustrates an umbrella 40 where only a single panel 44 of the canopy between two elongated supports is made from a one-way material. The remaining panels 42, 46, 48, 50 and 54 are opaque.

Figure 4:
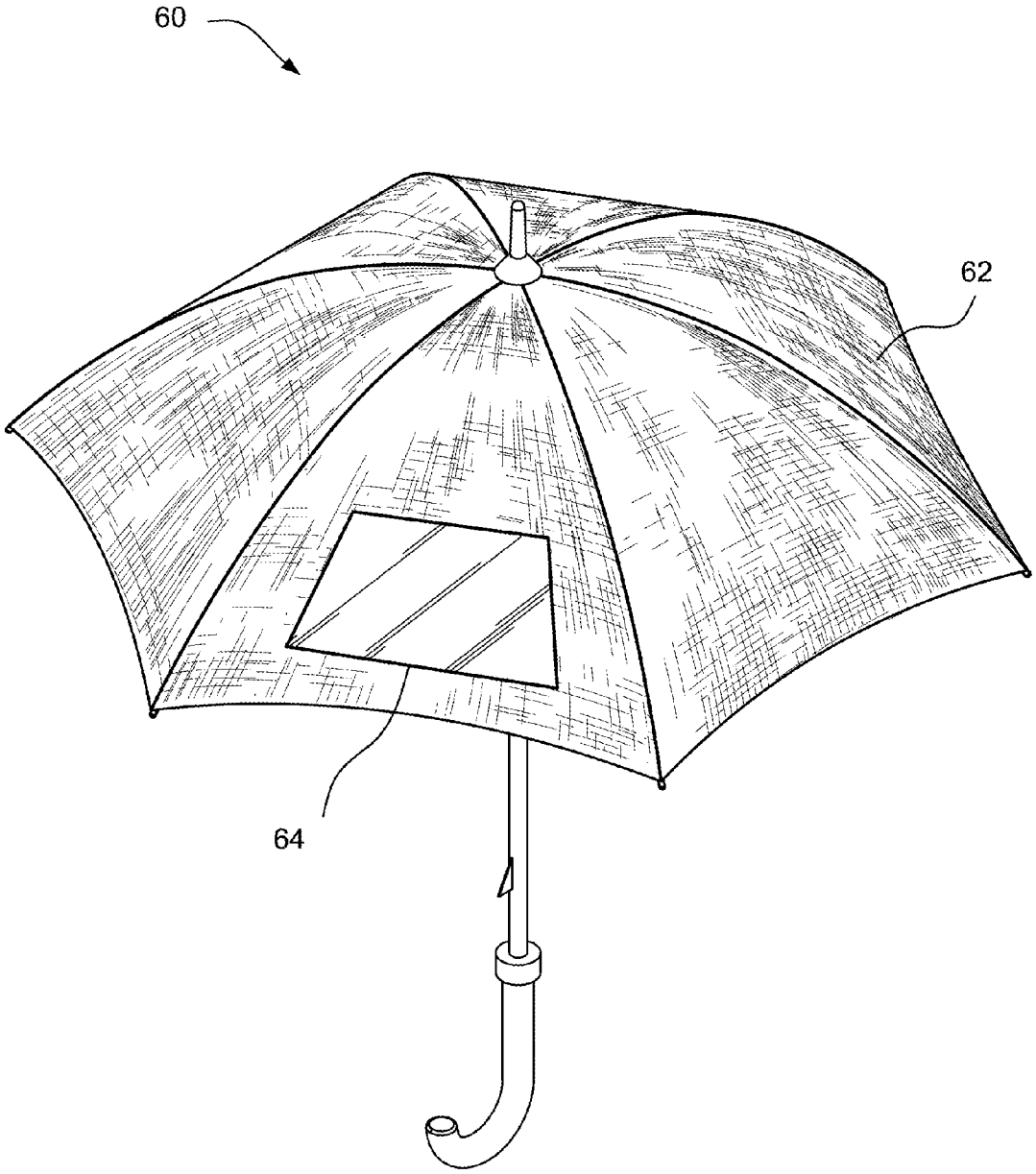
FIG. 4 depicts a fourth embodiment of a privacy umbrella.

FIG. 4 illustrates an umbrella 60 where the majority of the canopy 62 is made from an opaque material, but where a window 64 of one-way material is inset in the canopy. In this embodiment, the window is completely surrounded by the opaque material.

Figure 5:
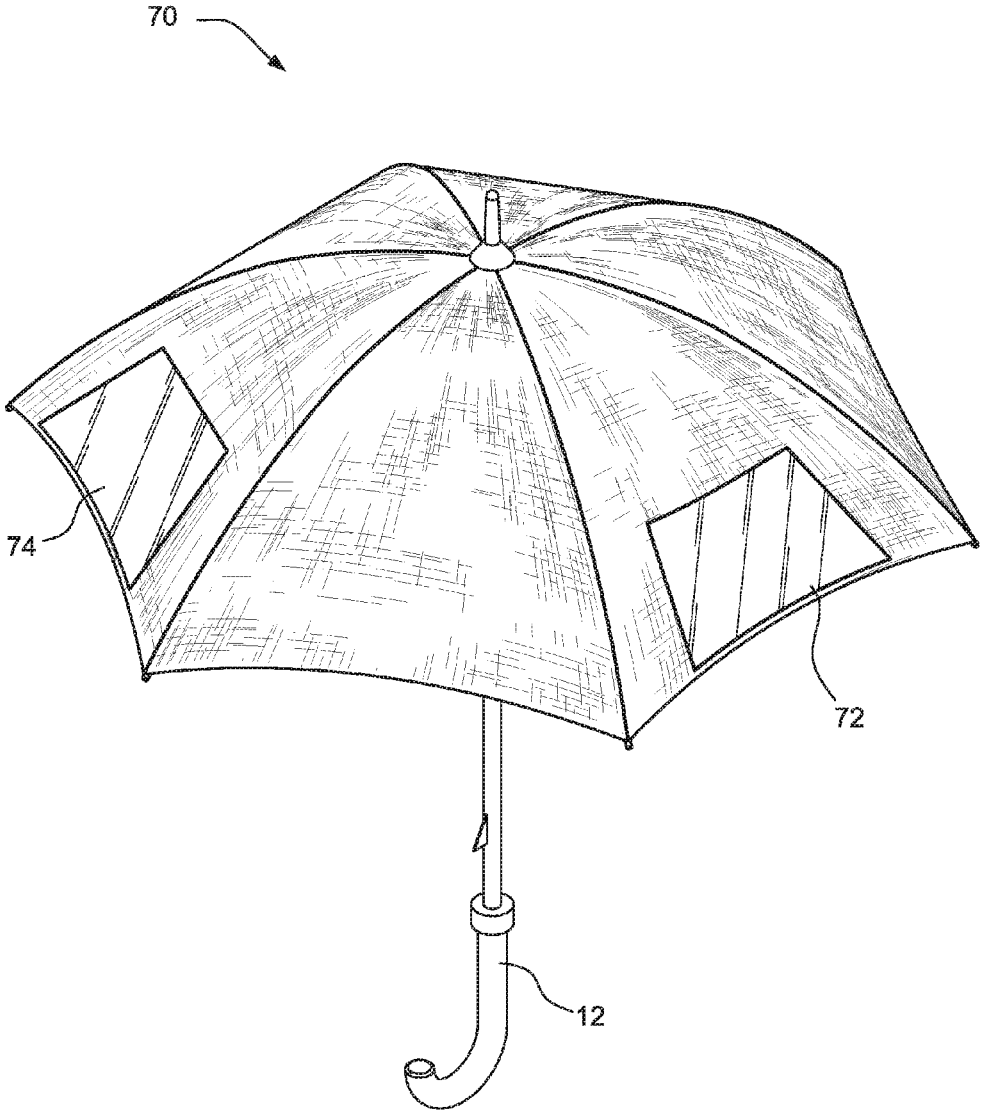
FIG. 5 depicts a fifth embodiment of a privacy umbrella.

FIG. 5 illustrates an umbrella 70 where the majority of the canopy is made of an opaque material, but where two windows 72, 74 formed of a one-way material are provided at two locations along a lower edge of the canopy. In this embodiment, the windows 72, 74 of one-way material are surrounded on three sides by the opaque material of the canopy.

Although FIGS. 4 and 5 illustrate embodiments where the windows of one-way material are generally rectangular, in alternate embodiments, the windows of one-way material could have different shapes and configurations. Also, a single window of one-way material could extend across multiple panels of the canopy that are mounted between the elongated supports. Further, some embodiments could include a single window or multiple windows positioned virtually anywhere on the canopy that provides an advantageous view outward for an individual positioned under the canopy.

Figure 6:
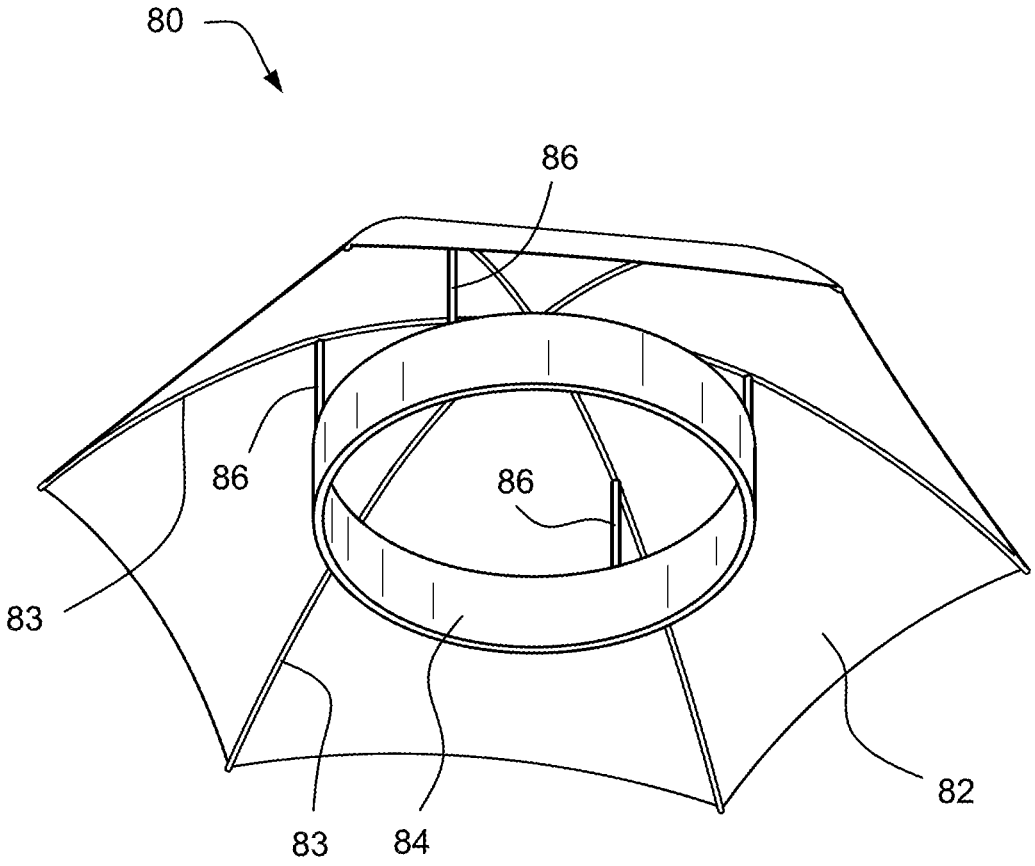
FIG. 6 depicts a sixth embodiment of a privacy umbrella.

In the embodiments illustrated in FIGS. 1-5, the umbrellas have a handle that is configured to be held by an individual positioned under the canopy. In alternate embodiments, the frame of elongated supports could instead be attached to a holding structure that is configured to be removably attached to a body of an individual. For example, FIG. 6 illustrates an umbrella 80 having a canopy 82 attached to a plurality of elongated supports 83. A holding structure is then attached to the elongated supports 83. In this embodiment, the holding structure includes a headband 84 that is configured to be removably attached to an individual's head. The headband is attached to the elongated supports 83 by a plurality of upright members 86. In this embodiment, all or a portion of the canopy 82 is formed of a one-way material.

Although FIG. 6 illustrates an embodiment with a headband 84 that is configured to be removably attached to a user's head, in alternate embodiments the holding structure could be configured to be removably attached to other portions of a user's body, such as an arm.

The one-way material used in the above-described embodiments could take a variety of different forms. In some instances, a single layer of a flexible material could provide the one-way functionality. In other instances a multi-layer construction could be used, with one or more layers being transparent, and one or more layers ensuring that the user can see outward, but that people on the outside of the canopy cannot see inward through the one-way material. For example, a reflective coating could be applied to a transparent material layer to achieve the one-way functionality. In other embodiments, the flexible material itself could have reflective properties which provide the one-way function.

In some embodiments, the one-way material could include a plurality of transparent portions which are surrounded by opaque portions. For example, the one-way material could have a plurality of transparent portions that are located within an otherwise opaque material. The amount of surface area of the one-way material that is transparent will affect the degree to which a user inside the canopy can see outward through the one-way material, and the degree to which people outside the canopy can see inward through the one-way material. One can selectively vary the percentage of the total surface area of the transparent portions of the one-way material relative to the percentage of the total surface area covered by the opaque portions to provide a better or worse view outward, and to provide a better or worse view inward.

A multi-layer structure that includes a transparent material layer bonded to a perforated opaque layer could form the one-way material. The transparent layer would ensure that the one-way material is waterproof. The perforated opaque material would ensure that the one-way material allows an individual under the canopy to see outward, and that people outside the canopy cannot see inward. The perforations would be sufficiently large to allow the user to obtain a reasonably good outward view through the one-way material, but sufficiently small to prevent people outside the canopy from obtaining a good inward view through the one-way material, particularly because there would be little ambient light present under the canopy.

Of course, other materials and designs could also be used to achieve the one-way functionality. Virtually any material or combination of material layers that allow a user to obtain an effective outward view through the one-way material, and which also prevents people outside the canopy from obtaining an effective inward view through the one-way material could be used.

The materials that are used to form the canopy are also desirably waterproof so that the canopy can shield a user from rain. However, a waterproof coating applied to a material layer or combination of material layers that provide one-way functionality could be used to form all or portions of the canopy.

The materials used to form the canopy are also desirably capable of blocking a significant portion of sunshine or radiation to help shield the user from sun and ultraviolet radiation. Of course, a reflective material layer could be added to a material layer or material layers that provide the one-way functionality.

In some embodiments, the opaque material portions of the canopy could be patterned, or include various graphical designs. However, the one-way material may also be patterned and include graphical designs. In some embodiments, the patterns and/or graphical designs on the opaque portions of the canopy and the one-way material portions of the canopy would form a single overall design or pattern. In other words, the one-way material portions could continue and complete a pattern or design formed on the opaque portions of the canopy.

Although the embodiments described above and illustrated in the drawings all relate to umbrellas having fairly typical and common shapes, in alternate embodiments, a privacy umbrella embodying the invention could have any shape that provides rain or sun coverage for a user. Thus, the described umbrellas should in no way be considered limiting of the shape or configuration of an umbrella embodying the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An umbrella, comprising:

a frame that is movable between a closed position and an open position, wherein the frame comprises a plurality of elongated supports;

a canopy that is attached to the frame and that is formed of a plurality of panels, wherein each panel extends all the way between two of the plurality of elongated supports, wherein the canopy is movable with the frame between the closed position and the open position, wherein the canopy forms a protective surface when in the open position, and wherein at least one panel of the canopy is formed of a one-way material that is configured such that an individual inside the canopy can see outward through the one-way material, and such that an individual outside the canopy cannot effectively see inward through the one-way material, wherein the one-way material includes a plurality of substantially transparent portions that are located within an otherwise opaque material; and a support structure attached to the frame and configured to support the frame and the canopy above an individual.

2. The umbrella of claim 1, wherein a plurality of the panels are made of the one-way material.

3. The umbrella of claim 2, wherein each of the panels of one-way material are positioned between panels of opaque material.

4. The umbrella of claim 1, wherein a portion of the canopy formed of the one-way material is at least partially surrounded by opaque portions of the canopy.

5. The umbrella of claim 1, wherein the support structure comprises a handle configured to be held by an individual.

6. The umbrella of claim 1, wherein the support structure comprises a holding structure that is configured to be removably attached to a body of an individual.

7. The umbrella of claim 6, wherein the holding structure is configured to be removably attached to an individual's head.

8. The umbrella of claim 1, wherein the one-way material is configured such that the plurality of substantially transparent portions cover less than 50% of the surface area of the otherwise opaque material.

9. An umbrella, comprising:

a frame that is movable between a closed position and an open position, wherein the frame comprises a plurality of elongated supports;

a canopy that is attached to the frame and that is formed of a plurality of panels, each of which extends between two of the plurality of elongated supports, wherein the canopy is movable with the frame between the closed position and the open position, wherein the canopy forms a protective surface when in the open position, and wherein at least a portion of the canopy is formed of a one-way material that is configured such that an individual inside the canopy can see outward through the one-way material, and such that an individual outside the canopy cannot effectively see inward through the one-way material, wherein the one-way material includes a plurality of substantially transparent portions that are located within an otherwise opaque material; and a support structure attached to the frame and configured to support the frame and the canopy above an individual.

10. The umbrella of claim 9, wherein the one-way material is configured such that the plurality of substantially transparent portions cover less than 50% of the surface area of the otherwise opaque material.

11. The umbrella of claim 9, wherein at least one of the panels of the canopy is formed of the one-way material.

12. The umbrella of claim 9, wherein a plurality of the panels of the canopy are made of the one-way material.

13. The umbrella of claim 12, wherein each of the panels of one-way material are positioned between panels of opaque material.

14. The umbrella of claim 9, wherein the at least a portion of the canopy formed of the one-way material comprises a window of the one-way material that is at least partially surrounded by opaque portions of the canopy.

15. The umbrella of claim 14, wherein the window of one-way material is completely surrounded by opaque portions of the canopy.

16. The umbrella of claim 14, wherein the one-way material is configured such that the plurality of substantially transparent portions cover less than 50% of the surface area of the otherwise opaque material.

* * * * *